US009126708B2

(12) United States Patent
Hasler et al.

(10) Patent No.: US 9,126,708 B2
(45) Date of Patent: Sep. 8, 2015

(54) DEVICE FOR LABELING CONTAINERS AND METHOD FOR CONTROLLING THE DEVICE FOR LABELING CONTAINERS

(71) Applicant: KRONES AG, Neutraubling (DE)

(72) Inventors: Uwe Hasler, Regensburg (DE); Jörg Triebel, Alteglofsheim (DE)

(73) Assignee: KRONES AG, Neutraubling (DE)

( * ) Notice: Subject to any disclaimer, the term of this patent is extended or adjusted under 35 U.S.C. 154(b) by 8 days.

(21) Appl. No.: 14/160,724

(22) Filed: Jan. 22, 2014

(65) Prior Publication Data

US 2014/0290823 A1 Oct. 2, 2014

(30) Foreign Application Priority Data

Mar. 26, 2013 (DE) ..... 10 2013 205 351

(51) Int. Cl.

| | |
|---|---|
| ***B65C 9/04*** | (2006.01) |
| ***B65C 3/08*** | (2006.01) |
| ***B65C 3/16*** | (2006.01) |
| ***B65C 9/36*** | (2006.01) |
| ***B65C 9/40*** | (2006.01) |

(52) U.S. Cl.

CPC ... *B65C 3/08* (2013.01); *B65C 3/16* (2013.01); *B65C 9/04* (2013.01); *B65C 9/36* (2013.01); *B65C 9/40* (2013.01); *Y10T 156/10* (2015.01); *Y10T 156/1768* (2015.01)

(58) Field of Classification Search

CPC ..... B65C 3/08; B65C 3/14; B65C 3/16; B65C 9/04; B65C 9/30; B65C 9/36; Y10T 156/1768

USPC ..... 156/362, 566

See application file for complete search history.

(56) References Cited

U.S. PATENT DOCUMENTS

| | | | | |
|---|---|---|---|---|
| 2006/0010836 | A1 * | 1/2006 | Kahlisch et al. | 53/415 |
| 2011/0146880 | A1 | 6/2011 | Kramer et al. | |
| 2013/0160922 | A1 | 6/2013 | Zwilling | |

FOREIGN PATENT DOCUMENTS

| | | | |
|---|---|---|---|
| DE | 3137201 | A1 | 3/1983 |
| DE | 8527438 | U1 | 11/1985 |
| DE | 202004009707 | U1 | 8/2004 |

(Continued)

OTHER PUBLICATIONS

Search report for German Application No. 10 2013 205 351.7, dated Oct. 25, 2013.

*Primary Examiner* — Philip Tucker
*Assistant Examiner* — John Blades
(74) *Attorney, Agent, or Firm* — Marshall, Gerstein & Borun LLP

(57) ABSTRACT

A device, and related method for controlling the device, for labeling containers with a container conveyor, having at least one container rotation device to rotate a container in a first direction about an axis, in a second direction about this axis in the opposite direction or not to rotate this container, with at least two labeling stations each with a labeling assembly and a pressing-on device, with a control device generating control commands for the container rotation device based on activity information of the labeling stations. In the region of an inactive labeling station, the container rotation device is rotated in the first direction, so that a container of the container rotation device can roll onto the pressing-on device and in the region of an active labeling station, the container device is rotated in the second direction, so that a label applied to the container can be pressed on.

14 Claims, 7 Drawing Sheets

(56) References Cited

FOREIGN PATENT DOCUMENTS

| | | | |
|---|---|---|---|
| DE | 60015376 | T2 | 5/2005 |
| DE | 102008051791 | A1 | 4/2010 |
| DE | 102008062064 | A1 | 6/2010 |
| DE | 102009034217 | A1 | 1/2011 |
| DE | 102010045661 | A1 | 3/2012 |
| EP | 2098455 | A1 | 9/2009 |
| JP | H1179150 | A | 3/1999 |

* cited by examiner

DEVICE FOR LABELING CONTAINERS AND METHOD FOR CONTROLLING THE DEVICE FOR LABELING CONTAINERS

CROSS-REFERENCE TO RELATED APPLICATION

The present application claims the benefit of priority of German Application No. 10 2013 205 351.7, filed Mar. 26, 2013. The priority application is incorporated herein by reference in its entirety.

FIELD OF THE DISCLOSURE

The disclosure relates to a device for labeling containers and a method for controlling the device for labeling containers, such as used in container production and filling operations.

BACKGROUND

The utility model specification DE 20 2004 009 707 U1 discloses a device for labeling containers comprising a container conveyor having labeling stations operationally alternating positioned in its periphery, with a label transfer and dispensing device for labels adhering to a carrier web which are in the transfer region via the dispensing device adhesively applied to a container jacket having a superimposed self-rotation, and with a pressing-on device comprising a pressing-on element for pressing-on the labels dispensed to the containers. The pressing-on element of an inactive labeling station is movable from its working position to a resting position at least slightly beyond the container movement plane.

A device is known from EP 2 098 455 A1 for applying labels to containers comprising a first pressing-on unit, which presses the labels onto an outer wall of the containers. The first pressing-on unit is at least in a partial region in the longitudinal direction of the containers shorter than the label to be applied. The first pressing-on unit can be displaceable relative to the transport path of the containers.

DE 10 2008 062 064 A1 discloses a method and device for controlling a machine for handling containers in which the machine comprises a plurality of respective motor-driven turntables for aligning the containers. The motorized drives of the turntables are each monitored separately, and in the event of malfunction of one or more of the turntable drives, the affected faulty turntable drives can be deactivated while operation of the machine continues. In addition, each of the deactivated turntable drives triggers at least a partial deactivation of respective subsequent processing and/or treatment steps of the container positions associated with the deactivated turntable drives of the machine.

DE 10 2009 034 217 A1 discloses a control device for turntables in labeling machines, where two or more system points are defined that can be spatially or temporally passed by the turntable. One or more rotary profiles between the first and the second system point are defined, where a rotary profile describes a rotational motion of the turntable using a drive element; the turntables can be rotatable in a clockwise and/or anticlockwise direction. Due to the control device, it is possible to configure the rotational motion of the turntable more flexibly, it is also possible to avoid unnecessary rotational motion of the turntable. A labeling machine can have a control element that decides which rotation profile is to be used when passing a certain system point.

DE 31 37 201 A1 discloses a labeling machine with multiple turntables, the self-rotation of which is for one revolution of the turntable controllable such that the labeling objects received by them pass the labeling devices and brush-on devices stationed in the periphery of the turntable with certain movement conditions. For example, the turntables can be swung in alternating directions of rotation or held in certain angular positions.

SUMMARY OF THE DISCLOSURE

One aspect of the disclosure is to apply labels under high-performance conditions to various container diameters and in different areas of the surface of the containers by an effective and functionally reliable device, where application of the labels is also ensured interchangingly with several redundantly operating label transfer devices also without interruption of the labeling process.

The present disclosure understands the term "container" to mean any receptacle such as bottles, cans, jars with and without screw cap, etc. that is suited for receiving any product such as beverages, food, pharmaceuticals etc. In the following, only containers are named for reasons of simplicity.

The device for labeling containers includes:

a container conveyor, such as a carousel or a linear conveyor, which is adapted to convey containers along a transport path, at least one container rotation device, such as a turntable, a gripper or a centering bell, where each container rotation device is adapted to receive a container and where each container rotation device is further adapted to rotate this one container in a first direction about an axis or to rotate it in a second direction about the axis in the opposite direction or to not rotate this container, at least two labeling stations, where each labeling station comprises a labeling assembly and a pressing-on device, where the labeling assembly is adapted to provide labels to be applied to containers, where the pressing-on device is adapted to press a label applied to a container onto the container, control device generating control commands for the at least one container rotation device based on activity information of the at least two labeling stations, where:

- the container rotation device is in a first region of an inactive labeling station rotated in the first direction, so that a container on the container rotation device by rotation in the first direction can roll completely or partially onto the pressing-on device of the inactive labeling station; and
- the container rotation device is in a second region of an active labeling station rotated in the second direction, so that by the rotation in the second direction a label applied to a container of the container rotation device by the labeling assembly of the active labeling station can be completely or partially pressed onto the container by the pressing-on device of the active labeling station.

With the container conveyor, containers being received from a container rotation device can on the one hand be passed along various processing stations such as labeling stations, and on the other hand, can be rotated about an axis, for example, about the longitudinal axis of the container or about an axis that is perpendicular to a transport plane.

A labeling assembly generally comprises a label web having a plurality of labels arranged on a carrier material. The label is separated from the carrier material and the label is subsequently supplied to the container and is pressed onto the container using a pressing-on device.

The present disclosure comprises at least two labeling stations which are intended for labeling containers with the same kind of label. For a disruption-free labeling process, it is provided that one of the labeling stations is active. Active in this case means that the labeling assembly is equipped with labels and applies these labels onto containers which are by the container conveyor and the container rotation devices being moved past this active labeling station and that these applied labels are then pressed onto the container with the pressing-on device. Pressing onto the container is presently done by mechanical interaction with the pressing-on device, so that pressure is applied in an area where the container and the pressing-on device contact each other resulting in the label being pressed on. Since the container and the pressing-on device generally only contact at a limited area not comprising the entire surface of the label, the label is first only partially pressed onto the container, and, in that the container conveyor and the container rotation device move the container along, is also in other areas pressed onto the container so that the label is entirely or partially pressed onto the container when the container leaves the labeling station, depending on the proportions in size of the label, the container and/or the pressing-on device.

For applying the labels and pressing-on the applied labels, the container rotation devices in the second region of an active labeling station rotate in the second direction. A second region can presently be understood to be the physical extension of the active labeling station along the transport path or the physical extension which was extended by further regions upstream and downstream of the active labeling station.

Assuming that conveyance of the containers using the container conveyor is effected in a conveying direction along the transport path, then rotation in the second direction is given in that a point on the surface of the container being adjacent to the labeling station also moves in the conveying direction in a superimposed manner by rotation of the container rotation device.

With a view from above onto the device for labeling being represented in a two-dimensional drawing plane, the conveying direction of a linear conveyor can in this drawing plane be oriented forwardly and, when the active labeling station is located to the left of the linear conveyor, rotation of the container rotation device is effected clockwise in the second direction. It is assumed for a carousel that it rotates in the clockwise direction and that the active labeling station is arranged at the outer periphery of the carousel. Rotation of the container rotation device occurs clockwise in the second direction.

By providing at least two labeling stations intended for labeling containers with the same kind of label, it is possible to equip one labeling assembly of an inactive labeling station with new labels while another labeling station is active, so that there is no interruption of the labeling process. A labeling station is referred to as being inactive because it does not apply labels onto containers and does not press-on any labels onto containers; an inactive labeling station can presently be equipped with labels or not be equipped with labels.

Containers are by the container conveyor and the container rotation device also moved past an inactive labeling station. If the container rotation devices, as in the case of the active labeling station, would there also be rotated in the second direction, then the pressing-on device of an inactive labeling station would experience wear during contact of a container with the pressing-on device. In addition, a label, which has been applied by an active labeling station onto a container before the container is moved along the inactive labeling station, can experience stress due to the contact with the pressing-on device.

It is therefore provided that the container rotation device is in a first region of an inactive labeling station rotated in the first direction, so that a container of the container rotation device can roll completely or partially onto the pressing-on device of the inactive labeling station. A first region can presently be understood to be the physical extension of the inactive labeling station along the transport path or the physical extension which was extended by further regions upstream and downstream of the inactive labeling station.

Whether a container rolls completely or partially onto the pressing-on device depends on the circumference of the container, the length of the pressing-on device and/or the velocity at which the container is moved along the pressing-on device. It is also possible that the rolling process is superimposed by a slip, where the container is drawn with the label along the pressing-on device. A container can also at its circumference comprise one or multiple recesses, so that there can be no rolling onto the pressing-on device in the area of the recesses.

By having the containers rolling completely or partially onto the pressing-on device of an inactive labeling station, wear of the pressing-on device is significantly reduced. Moreover, labels that have already been applied by an active labeling station onto a container also experience no stress when the container passes an inactive labeling station.

With a view from above onto the device for labeling being represented in a two-dimensional drawing plane, the conveying direction of a linear conveyor can in this drawing plane be oriented forwardly and, when the inactive labeling station is located to the left of the linear conveyor, rotation of the container rotation device is effected anticlockwise in the first direction. It is assumed for a carousel, that it rotates in the clockwise direction and that the inactive labeling station is arranged at the outer periphery of the carousel. Rotation of the container rotation device occurs anticlockwise in the first direction.

The activity information of the at least two labeling stations can pertain to the respective current state of a labeling station, for example, inactive or active. The control device generates control commands for the at least one container rotation device based on the activity information. Therefore, the individual container rotation devices can be prompted to respectively rotate in the first direction or the second direction.

Changing the direction of rotation from the first direction to the second direction and vice versa is preferably not performed abruptly but, for example, by slowing down the rotational speed until a standstill is reached and then increasing the rotational speed in the other direction.

The container conveyor can be adapted to convey the containers with a conveying velocity $\vec{v}_T$ along the transport path, where the rotation in the first direction is configured to perform the container rotation device of the inactive labeling station at a first velocity $\vec{v}_1$. In the rolling-on region $\vec{p}$, the absolute value $|\vec{v}_1(\vec{p})|$ of the first velocity is equal to the absolute value $|\vec{v}_T(\vec{p})|$ of the conveying velocity, i.e. it is true that $|\vec{v}_1(\vec{p})|=|\vec{v}_T(\vec{p})|$, and in the rolling-on region $\vec{p}$, the first velocity $\vec{v}_1(\vec{p})$ and the conveying velocity $\vec{v}_T(\vec{p})$ are additionally oriented in opposite directions, i.e. it is true that $\vec{v}_1(\vec{p})=-\vec{v}_T(\vec{p})$.

The rolling-on region of the container onto the pressing-on device is generally laminar, but is presently described by the vector $\vec{p}$.

A velocity vector is defined by the direction of movement and the absolute value. The absolute value presently specifies which distance a point of a body travels within a certain period of time. It is therefore generally true that:

$$\vec{v} = \lim_{t \to 0} \frac{\Delta \vec{r}(t)}{\Delta t},$$

where t is the time and $\vec{r}$ is the position vector.

Due to the fact that the conveying velocity and the first velocity in the rolling-on region are equal in absolute value, but are opposite in direction, the container can roll optimally onto the pressing-on device of the inactive labeling station because the container is not drawn along the pressing-on device. This could happen if the absolute values of the two velocities were not equal.

The pressing-on device can comprise brush members. Even when container surfaces exhibit unevenness, the brush members can also provide for properly pressing labels onto such a surface.

In another embodiment, the pressing-on device can comprise a formed member which is provided with a support comprising foam, where the foam is preferably closed-cell. Closed-cell foam does not absorb liquids since the walls between the individual cells are completely closed.

The support can be covered with foil. Any ingress of liquid into the material of the support, e.g. the foam, and/or any wetting of the material of the support, e.g. the foam, with liquid can be avoided, and therefore foam being open-cell, closed cell and/or mixed-cell—comprising open-cell and closed-cell foam—can be used as foam. Open-cell foam has cell walls that are not closed, so that open-cell foam can absorb liquid.

In the event of foil wear, it can be replaced, where the support, i.e. also the foam, does not need to be replaced, but the support can be covered with new foil.

It can also be provided to use integral foam as foam Integral foam comprises a core of foam cells, and a cell-free surface, which can be regarded as a kind of skin; the density in integral foam increases from the inside to the outside. Also in this case, the foam can additionally be covered with foil.

The pressing-on device can also comprise a roller, where the roller can comprise rubber-elastic material and/or foam. The roller is preferably mounted rotatable about its axis parallel to the container axis.

To protect the roller against wear and tear, at least the cover surface of the roller can be covered with foil.

In another embodiment, the pressing-on device can comprise foam with a tape, where the tape comprises polytetrafluoroethylene.

In a further embodiment, the pressing-on device can comprise a brush body, where the brush body comprises a plastic body on which individual bristle members are arranged. A brush member can be embodied as a cluster of individual bristles, where the ends of the bristles coming into contact with the containers and/or labels are designed such, for example, are rounded, that the containers and/or labels are not damaged. A bristle member can also be embodied as an individual bristle, where the end of the bristle coming into contact with the containers and/or labels is designed such, for example, is rounded, that the containers and/or labels are not damaged.

The pressing-on devices can presently be geometrically designed such that they are suitable for use in a carousel or for use in a linear conveyor, respectively. In a pressing-on device comprising a formed member being provided with a support, it can be provided (a) for the use in a carousel, that the formed member is curved corresponding to the radius of the carousel, so that the support is located on the convex side of the formed member, and (b) for the use in a linear conveyor, that the formed member is straight.

The like can be provided for a pressing-on device comprising a brush body, where the brush body comprises a plastic body on which individual bristle members are arranged. In this case, the plastic body would then be designed in a curved or straight manner, respectively.

Furthermore, the disclosure relates to a method for controlling a device for labeling containers such as described farther above or farther below, where the method comprises the step of conveying a container being received by a container rotation device of the device along the transport path using the container conveyor of the device. The method further comprises the step of rotating the container device in the first direction in the first region of an inactive labeling station or rotating the container device in the second direction in the second region of an active labeling station.

BRIEF DESCRIPTION OF THE FIGURES

Further advantages and embodiments result from the accompanying drawings.

DETAILED DESCRIPTION

Figure 1:
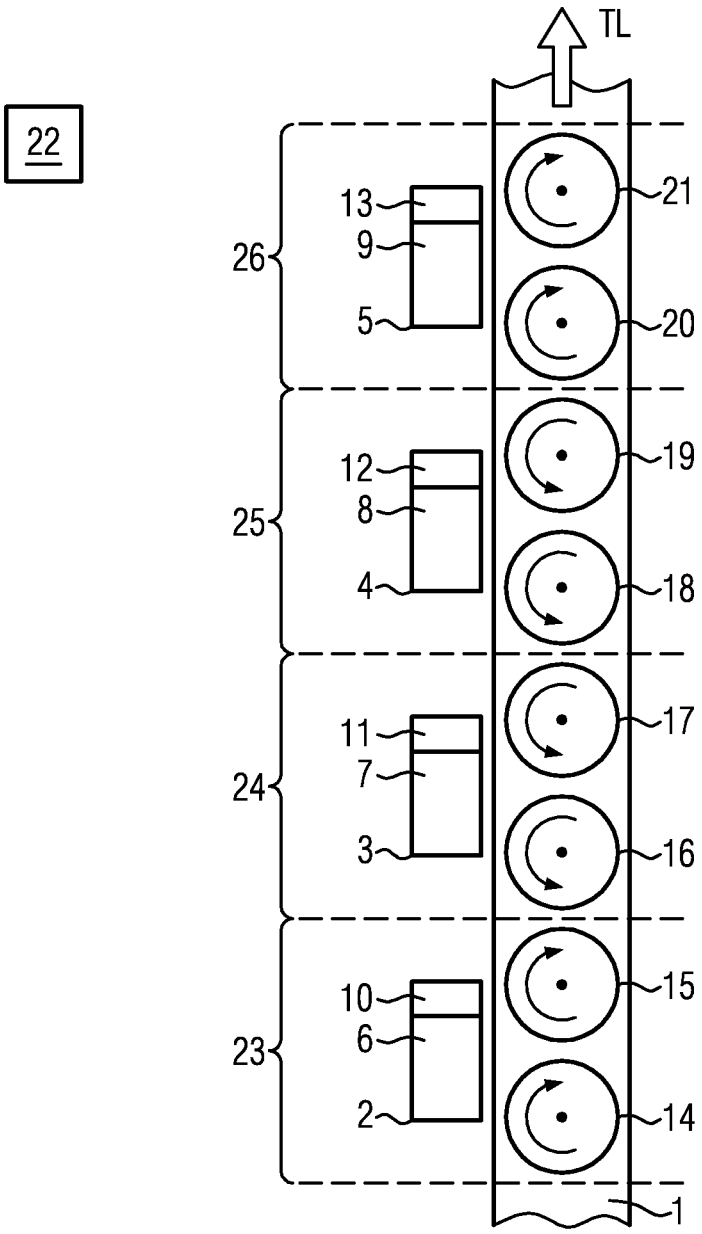
FIG. 1 shows a plan view of a device for labeling comprising a linear conveyor.

FIG. 1 shows a plan view of a device for labeling comprising a linear conveyor 1, which moves in a direction of transport TL. On the left hand side of the linear conveyor 1, four labeling stations 2, 3, 4, 5 are shown, each comprising a labeling assembly 6, 7, 8, 9 and a pressing-on device 10, 11, 12, 13. It is provided that the first two labeling stations 2, 3 (along the transport path) are adapted to apply a first kind of label—e.g. front labels—to containers, whereas the other two labeling stations 4, 5 are adapted to apply a second kind of label—e.g., rear labels—to the containers.

Eight container rotation devices 14, 15, 16, 17, 18, 19, 20, 21 are shown, they can be turntables, centering bells or centering punches, which are adapted to rotate containers in a first direction (e.g. in the anticlockwise direction) about a longitudinal axis of the container or about an axis perpendicular to a transport plane or in a second direction (e.g. in a clockwise direction) or not to rotate the containers. Each of the container rotation devices 14-21 is individually controllable in order to be able to rotate a container in a desired manner for labeling and/or for another handling process. Using a control device 22, a direction of rotation and/or a rotational speed of a container rotation device can be controlled by control commands. Individual actuation of the container rotation devices is preferably effected via data bus control.

In FIG. 1, the first labeling station 2 and the fourth labeling station 5 are active, whereas the second labeling station 3 and the third labeling 4 are inactive. The four marked regions 23, 24, 25, 26 indicate the regions in which a container rotation device has substantially one direction of rotation. In the transition between two such regions, a change in direction of rotation can occur or the direction of rotation can be maintained. It is also possible to maintain or to change the absolute value of the rotational speed. In addition, the rotation can be halted for a period of time, for example, to change the direction of rotation of a container rotation device.

In FIG. 1, the direction of transport TL is in the image plane directed upwardly. Accordingly, a container rotation device is in the region of an inactive labeling station rotated in the anticlockwise direction and in the region of an active labeling device is rotated in the clockwise direction. The first labeling station 2 is active, and thereby the container rotation devices 14, 15 are in a region 23 associated with the first labeling station 2 rotated in the clockwise direction. The second labeling station 3 is inactive, so that, in the transition of the region 23 associated with the first labeling station 2 to a region 24 associated with the second labeling station 3, a change in direction of rotation of the container rotation devices is effected, so that the container rotation devices 16, 17 rotate in the anticlockwise direction. Since the third labeling station 4 is likewise inactive, the direction of rotation of the container rotation devices 18, 19 can in a region 25 associated with the third labeling station 4 be maintained in the anticlockwise direction. The fourth labeling station 5 is active, so that, in the transition of the region 25 associated with the third labeling station 4 to a region 26 associated with the fourth labeling station 5, a change in direction of rotation of the container rotation devices is effected, so that the container rotation devices 20, 21 rotate in the clockwise direction.

Figure 2:
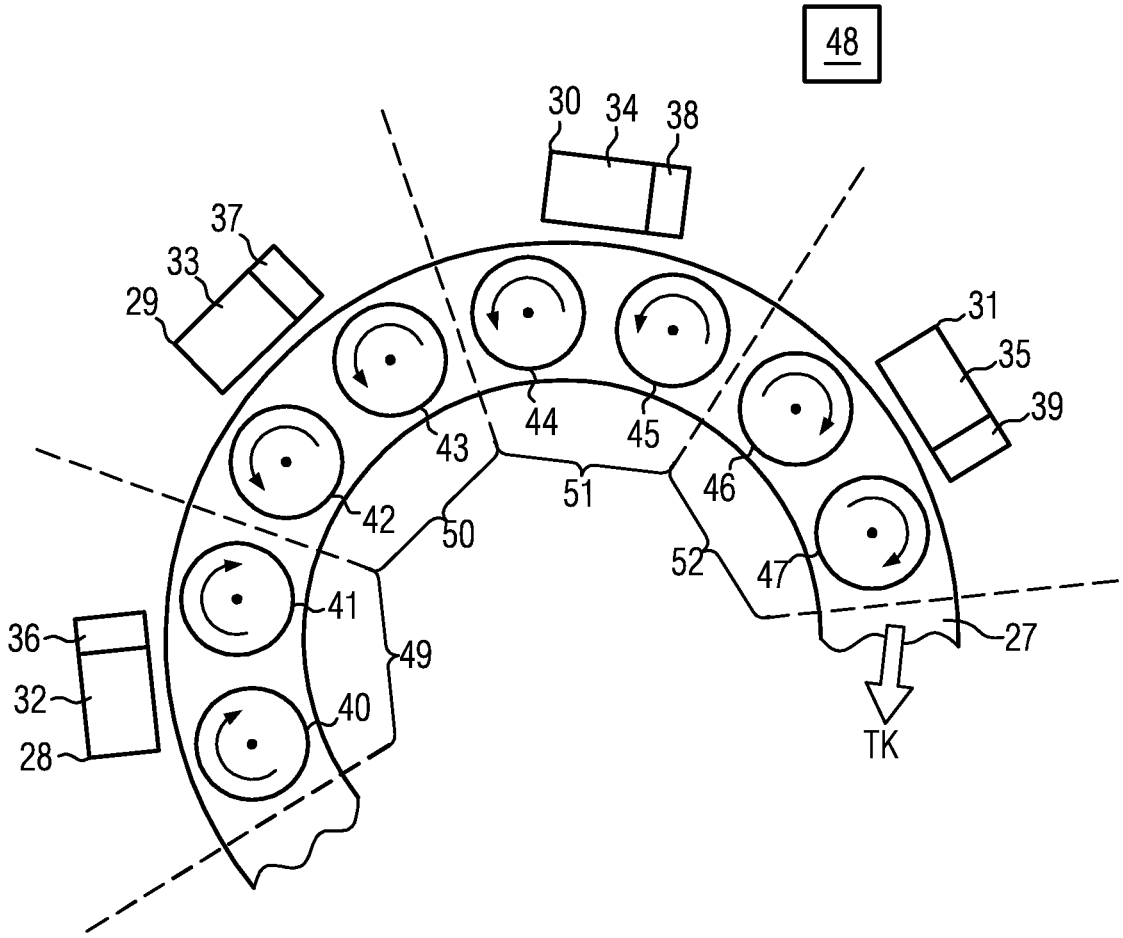
FIG. 2 shows a plan view of a device for labeling with a carousel.

FIG. 2 shows a plan view of a device for labeling with a carousel 27 which rotates in the clockwise direction and conveys objects in a direction of transport TK. At the outer perimeter of the carousel 27, four labeling stations 28, 29, 30, 31 are shown, each comprising a labeling assembly 32, 33, 34, 35 and a pressing-on device 36, 37, 38, 39. It is provided that the first two labeling stations 28, 29 (along the transport path) are adapted to apply a first kind of label—e.g. front labels—to containers, whereas the other two labeling stations 30, 31 are adapted to apply a second kind of label—e.g., rear labels—to the containers.

Eight container rotation devices 40, 41, 42, 43, 44, 19, 46, 47 are shown, they can be turntables, centering bells or centering punches, which are adapted to rotate containers in a first direction about a longitudinal axis of the container or about an axis perpendicular to a transport plane or in a second direction or not to rotate the containers. Each of the container rotation devices 40-47 is individually controllable in order to be able to rotate a container in a desired manner for labeling and/or for another handling process. Using a control device 48, a direction of rotation and/or a rotational speed of a container rotation device can be controlled by control commands. Individual actuation of the container rotation devices is preferably effected via data bus control.

In FIG. 2, the first labeling station 28 and the fourth labeling station 31 are active, whereas the second labeling station 29 and the third labeling station 30 are inactive. The four marked regions 49, 50, 51, 52 indicate the regions in which a container rotation device has substantially one direction of rotation. In the transition between two such regions, a change in direction of rotation can occur or the direction of rotation can be maintained. It is also possible to maintain or to change the absolute value of the rotational speed. In addition, the rotation can be halted for a period of time, for example, to change the direction of rotation of a container rotation device.

Since the carousel 27 rotates in the clockwise direction, a container rotation device is in the region of an inactive labeling station rotated in the anticlockwise direction and in the region of an active labeling device is rotated in the clockwise direction. The first labeling station 28 is active, and thereby the container rotation devices 40, 41 are in a region 49 associated with the first labeling station 28 rotated in the clockwise direction. The second labeling station 29 is inactive, so that, in the transition of the region 49 associated with the first labeling station 28 to region 50 associated with the second labeling station 29, a change in direction of rotation of the container rotation devices is effected, so that the container rotation devices 42, 43 rotate in the anticlockwise direction. Since the third labeling station 30 is likewise inactive, the direction of rotation of the container rotation devices 44, 45 can in a region 51 associated with the third labeling station 30 be maintained in the anticlockwise direction. The fourth labeling station 31 is active, so that, in the transition of the region 51 associated with the third labeling station 30 to a region 52 associated with the fourth labeling station 31, a change in direction of rotation of the container rotation devices is effected, so that the container rotation devices 46, 47 rotate in the clockwise direction.

Figure 3:
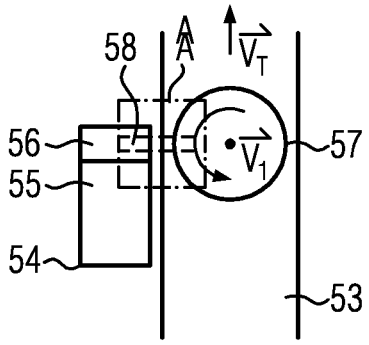
FIG. 3 shows a schematic view of a region where the rolling occurs.
Figure 3A:
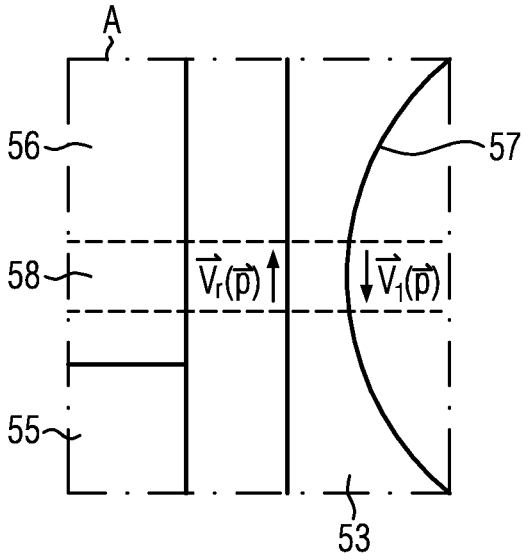
FIG. 3*a* shows an enlarged view of FIG. 3.

FIG. 3 shows a schematic view of a rolling-on region and 3*a* shows an enlarged view of section A of FIG. 3. The container conveyor 53 conveys the containers at a conveying velocity $\vec{v}_T$ and the container rotation device 57 rotates in the region of the inactive labeling station 54 at a first velocity $\vec{v}_1$ in the anticlockwise direction. The rolling-on region 58 of the container onto the pressing-on device 56 is generally laminar, but is presently described by the vector $\vec{p}$. Since the container conveyor 53 conveys the container rotation device 57 along the pressing-on device 56 at the conveying velocity $\vec{v}_T$, the rolling-on region 58 respectively moves on the pressing-on device 56. In FIGS. 3 and 3*a*, the rolling-on region 56 would move upwardly in the drawing plane.

In the case illustrated in FIG. 3, the conveying velocity $\vec{v}_T$ and the first velocity $\vec{v}_1$ of the container rotation device 57 have values such that, in the rolling-on region 58 the absolute value $|\vec{v}_1(\vec{p})|$ of the first velocity is equal to the absolute value $|\vec{v}_T(\vec{p})|$ of the conveying velocity, i.e. $|\vec{v}_1(\vec{p})|=|\vec{v}_T(\vec{p})|$, and that in the rolling-on region 58 the first velocity $\vec{v}_1(\vec{p})$ and the conveying velocity $\vec{v}_T(\vec{p})$ are oppositely oriented, i.e. $|\vec{v}_1(\vec{p})|=-|\vec{v}_T(\vec{p})|$.

Due to the fact that the conveying velocity and the first velocity in the rolling-on region are equal in absolute value, but are opposite in direction, the container can roll optimally onto the pressing-on device of the inactive labeling station because the container is not drawn along the pressing-on device.

Figure 4A:
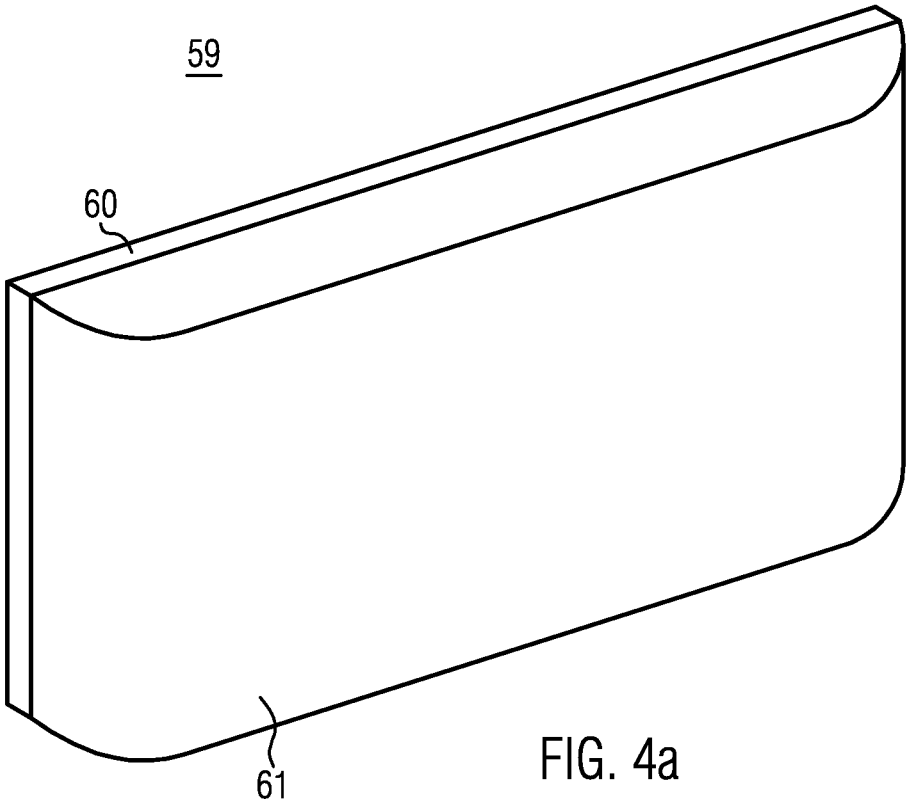
FIG. 4*a* shows a straight pressing-on device with a formed member which is provided with a support.
Figure 4B:
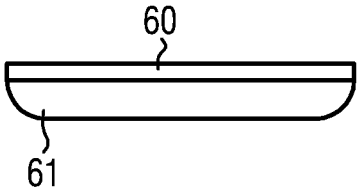
FIG. 4*b* shows a cross-section of FIG. 4*a;*

FIG. 4*a* shows a schematic view of a pressing-on device 59 with a formed member 60 being provided with a support 61. FIG. 4B shows a cross-section of this pressing-on device 59, in which the straight design of the formed member 60 can be seen. The surface of the support 61, onto which the containers can roll and be pressed, respectively, is preferably parallel to the straight surface of the formed member 60, whereas the support 61 can be tapered or rounded, respectively, at a beginning and an end portion of the pressing-on device 59. Tapering or rounding allows gentle transition of containers onto the pressing-on device or from the pressing-on device, respectively. Due to the straight shape of the formed member 60 and the support 61, the pressing-on device 59 is suitable for use in a linear conveyor. Various materials can be provided for the support 61, for example open-cell, closed-cell and/or mixed-cell foam, integral foam, or the like, preferably exhibiting elasticity.

Figure 4C:
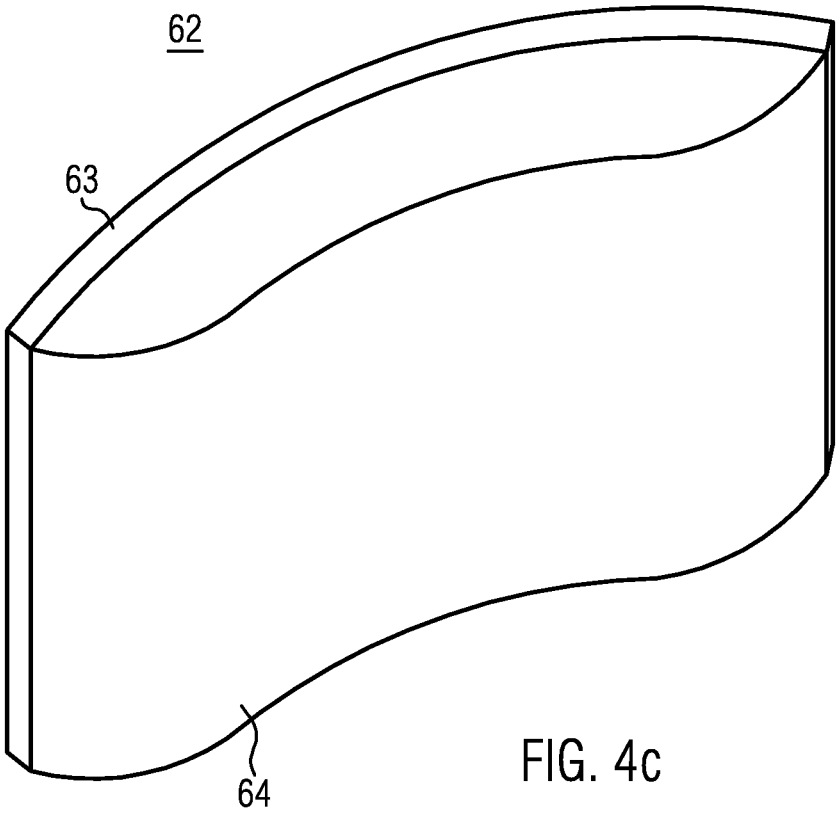
FIG. 4*c* shows a curved pressing-on device with a formed member which is provided with a support.
Figure 4D:
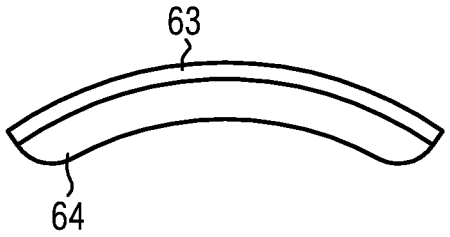
FIG. 4*d* shows a cross-section of FIG. 4*c;*

FIG. 4*c* shows a schematic view of a pressing-on device 62 with a curved formed member 63 being provided with a support 64. FIG. 4*d* shows a cross-section of this pressing-on device 62. The surface of the support 64, onto which the containers can roll and be pressed, respectively, preferably has the same or a similar curvature as the formed member 63, where the support 63 can be tapered or rounded, respectively, at a beginning and an end portion of the pressing-on device 62. Due to the curved shape of the formed member 63, the pressing-on device 62 is suitable for use in a carousel. The materials for the curved support 64 can correspond to those of the straight support 61 of the pressing-on device 59 with the straight formed member 60.

Figure 5:
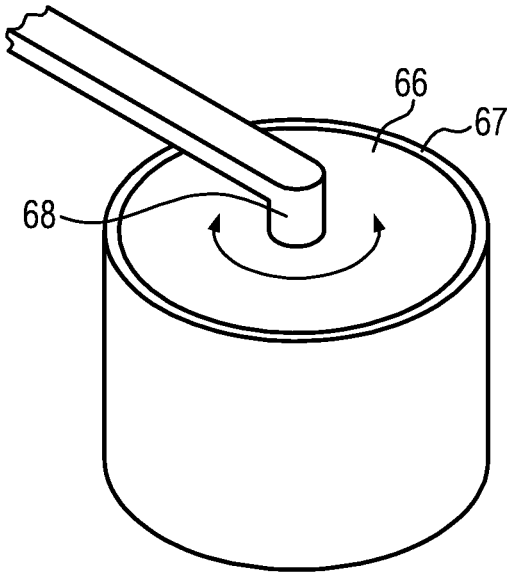
FIG. 5 shows a pressing-on device with a roller, where the cover surface of the roller is covered with foil.

FIG. 5 shows a pressing-on device 65 comprising a roller 66, where the cover surface of the roller 66 is covered with foil 67. The roller 66 is mounted rotatable about its axis 68 so that the roller 66 can rotate in the clockwise direction or in the anticlockwise direction depending on in which direction and with which direction of rotation a container rolls onto the roller 66 or is pressed thereonto. The roller 66 preferably comprises rubbery-elastic material and/or foam.

Figure 6A:
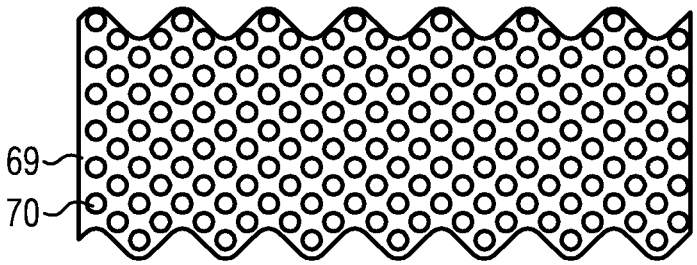
FIG. 6*a* shows a front view of a straight pressing-on device with a brush body comprising a plastic body on which individual bristle members are disposed.

FIG. 6*a* shows a front view of a pressing-on device 71 comprising a brush body with a plastic body 69 on which individual bristle members 70 are arranged. In the embodiment shown, the bristle members 70 are arranged symmetrically to each other on the plastic body 69. But it can also be provided that the bristle members are not arranged symmetrically with respect to each other or that a symmetrical arrangement of the bristle members 69 is provided only in some areas of the plastic body. A brush member can be embodied as a cluster of individual bristles, where the ends of the bristles coming into contact with the containers and/or labels are designed such, for example, rounded, that the containers and/or label are not damaged. A bristle member can also be embodied as an individual bristle, where the end of the bristle coming into contact with the containers and/or labels is designed such, for example, rounded, that the containers and/or label are not damaged.

Figure 6B:
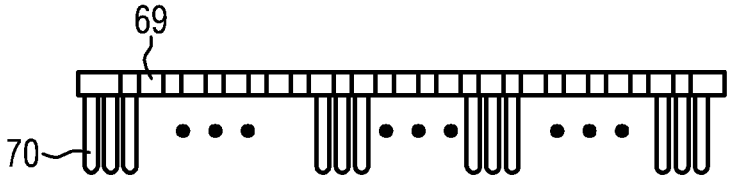
FIG. 6*b* shows a cross-section of FIG. 6*a*.

FIG. 6*b* shows a cross-section of the pressing-on device 71 from FIG. 6*a*. The plastic body 69 is embodied in a straight manner, where not all bristles members 70 are shown for reasons of clarity. Due to the straight shape of the formed member 69, the pressing-on device 71 is suitable for use in a linear conveyor.

Figure 6C:
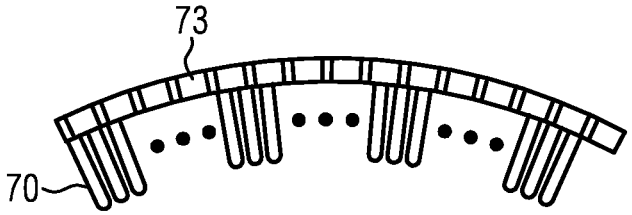
FIG. 6*c* shows a cross-section of a curved pressing-on device with a brush body.

FIG. 6*c* shows a cross-section of a pressing-on device 72 comprising a brush body with a curved plastic body 73 on which individual bristle members 70 are arranged. Not all bristle elements 70 are shown for reasons of clarity. Due to the curved shape of the formed member 73, the pressing-on device 72 is suitable for use in a carousel.

The invention claimed is:

1. A device for labeling containers, comprising:

a container conveyor which is adapted to convey containers along a transport path, at least one container rotation device where each of the at least one container rotation device is adapted to receive a container and where each container rotation device is further adapted to rotate the one container in a first direction about an axis, to rotate it in a second direction about the axis in the opposite direction, or to not rotate the container, at least two labeling stations, where each labeling station comprises a labeling assembly and a pressing-on device, where the labeling assembly is adapted to provide labels to be applied to containers, where the pressing-on device is adapted to press a label applied to a container onto the container and, a control device generating control commands for the at least one container rotation device based on activity information of the at least two labeling stations, where:

the at least one container rotation device is in a first region of an inactive labeling station rotated in the first direction, so that a container of the at least one container rotation device by rotation in the first direction can roll one of completely or partially onto the pressing-on device of the inactive labeling station; and the at least one container rotation device is in a second region of an active labeling station rotated in the second direction, so that a label applied to a container of the at least one container rotation device by the labeling assembly of the active labeling station can by rotation in the second direction be one of completely or partially pressed onto the container by the pressing-on device of the active labeling station.

2. The device according to claim 1, wherein the container conveyor is adapted to convey the containers at a conveying velocity ($\vec{v}_T$) along the transport path, and where the rotation in the first direction is configured to perform the container rotation device of the inactive labeling station at a first velocity ($\vec{v}_1$), and where in a rolling-on region (58, $\vec{p}$) the absolute value ($|\vec{v}_1(\vec{p})|$) of the first velocity ($\vec{v}_1$) is equal to the absolute value ($|\vec{v}_T(\vec{p})|$) of the conveying velocity ($\vec{v}_T$) and where in a rolling-on region (58, $\vec{p}$) of the container onto the pressing-on device the first velocity ($\vec{v}_1(\vec{p})$) and the conveying velocity ($\vec{v}_T(\vec{p})$) are oriented oppositely.

3. The device according to claim 1, wherein the pressing-on device comprises brush members.

4. The device according to claim 1, wherein the pressing-on device comprises a formed member being provided with a support comprising foam.

5. The device according to claim 4, wherein the foam comprises integral foam.

6. The device according to claim 4, wherein the support is covered with foil.

7. The device according to claim 4, wherein the foam is closed-cell.

8. The device according to claim 1, wherein the pressing-on device comprises a roller, where the roller comprises one of a rubbery-elastic material, foam, and a combination thereof.

9. The device according to claim 8, wherein at least a cover surface of the roller is covered with foil.

10. The device according to claim 1, wherein the pressing-on device comprises foam with a tape, where the tape comprises polytetrafluoroethylene.

11. The device according to claim 1, wherein the pressing-on device comprises a brush body, where the brush body comprises a plastic body on which individual bristle members are disposed.

12. The device according to claim 1, wherein the containers comprise one of bottles, cans, and receptacles.

13. The device according to claim 1, wherein the conveyor comprises one of a carousel and a linear conveyor.

14. The device according to claim 1, wherein the at least one container rotation device is one of a turntable, a gripper and a centering bell.

* * * * *